United States Patent [19]

Engelbart et al.

[11] 4,137,655

[45] Feb. 6, 1979

[54] APPARATUS FOR PRESSING TROUSERS

[75] Inventors: Wilhelm Engelbart; Dieter Nahr, both of Bergisch, Fed. Rep. of Germany

[73] Assignee: Euro Pressing Group Limited, Kendal, England

[21] Appl. No.: 840,804

[22] Filed: Oct. 11, 1977

[51] Int. Cl.[2] ..... D06F 71/28; D06F 71/40

[52] U.S. Cl. ..... 38/12; 38/15; 38/17; 38/27

[58] Field of Search ..... 38/27, 17, 20, 21, 69, 38/70, 12, 13, 14, 15, 16, 108

[56] References Cited

U.S. PATENT DOCUMENTS

| | | | |
|---|---|---|---|
| 2,517,331 | 8/1950 | McCauley | 38/12 |
| 2,859,545 | 11/1958 | Williams | 38/20 |
| 2,923,076 | 2/1960 | Linton | 38/12 |
| 3,425,141 | 2/1969 | Fuhring et al. | 38/21 |
| 3,715,818 | 2/1973 | Sassman | 38/15 |

*Primary Examiner*—Louis Rimrodt
*Attorney, Agent, or Firm*—Norris & Bateman

[57] ABSTRACT

A trouser pressing apparatus comprising two pairs of horizontal pressing plates, arranged at 90° – 110° to each other and two further pairs of pressing plates arranged above the horizontal pressing plates, carriages on which the lower plates are mounted, clamps for clamping the legs to the plates and for stretching the legs longitudinally, means for stretching the legs transversely, means for applying vacuum to the legs to hold them in position on the lower pressing plates and means for lowering the upper pressing plates onto the lower plates when these latter are in their rearward position and means for steaming and applying pressure to the trouser legs.

6 Claims, 6 Drawing Figures

APPARATUS FOR PRESSING TROUSERS

This invention relates to an improved apparatus for pressing trousers in which the trouser legs are placed individually on two horizontal pressing plates and with simultaneous stretchng in longitudinal and transverse directions are ironed by steaming and pressing.

The invention relates further to appartus for the carrying out of this method. In domestic use or in a tailoring business trousers are ironed by hand on an ironing board by means of an iron. This is a time consuming method and is not applicable in the garment industry. An attempt has therefore been made to develop a method for the pressing of trousers which permits of a higher working speed and yet takes into consideration the special difficulties whoch occur when pressing trousers. These difficulties result due to the fact that the trouser legs are sewn together from a front and a rear textile strip with the seams located on the two sides of each trouser leg. The trouser legs however are made with creases not on the sides but at the front and back. Since the width of the trouser legs varies from top to bottom there result irregularities in the seams as the seams are sewn in a straight line and thus upon being placed together prevent the trousers from lying flat. A flat position of the trousers when placed together however is absolutely necessary for the appearance when selling as well as for reasons of simple storage.

The pressing of the trousers therefore has not only the object of smoothing the material and providing folds and creases but in particular also to allow the irregularities resulting during manufacture to disappear. This is, of course, only possible because the textile fabrics from which the trousers are made can slightly expand in a longitudinal and a transverse direction.

Trousers on an industrial scale have therefore been pressed with the trouser legs placed individually on two horizontal pressing plates, stretched in a longitudinal direction and then ironed by steaming and pressing. This method, however, is not satisfactory but requires in order to remove the said irregularities a subsequent ironing or pressing by hand.

The object of the invention is an improvement in the aforesaid known method in which the ironed trouser legs lie flat in every case without any subsequent treatment being necessary.

According to the invention a method for pressing trousers comprises placing the trouser legs individually on a pair of lower horizontal pressing plates arranged at an angle of 90°–110° to each other, loading the trouser legs onto the pressing plates and clamping the legs thereto, stretching the legs longitudinally by moving the clamps outwardly, applying vacuum to the pressing plates to hold the legs thereon, removing the clamps, moving the pressing plates rearwardly vertically below pairs of upper pressing plates, closing the upper pressing plates onto the lower pressing plates, separating the upper pressing plates to stretch the legs transversely and applying steam through the lower pressing plates and pressure to press the legs, releasing the pressure and moving the carriage forwardly for unloading the press.

In particular the method according to the invention is carried out so that the trouser legs after placing on the plate are first of all pre-tensioned cold in a longitudinal direction and then stretched in the neighbourhood of the hollow of the knee at least in the seam region under the action of steam.

With this further development of the method places on the trouser legs in which a particularly large irregularity occurs are especially treated.

It is furthermore preferably arranged that after the stretching of the trouser legs the steam is drawn off from the cloth and the trouser legs under tension are ironed in a transverse direction over the whole surface by steaming and pressing.

The method according to the invention is carried out in an appratus having two elongated lower ironing plates for receiving the trouser legs and two upper ironing plates mounted above and lowerable thereonto. Further, each of the lower ironing plates is provided with a plurality of holes distributed over its surface with underneath one or more chambers for the introduction of steam and above each lower ironing plate a clamping device for the stretching of the trouser legthereon in a longitudinal direction. Such ironing devices for trousers are already known in the aforementioned form, but in order to be able to carry out the method according to the invention, according to a further feature each upper ironing plate consists of two part plates running parallel to an adjacent lower ironing plate, the part plates being movable apart from one another in pairs transversely of their longitudinal direction.

The clamping of the trouser legs in a transverse direction is effected by moving the upper pressing plates apart so that the portions of material of each trouser leg lying one above the other are stretched and thus tensioned transversely.

The upper pressing plates are preferably unheated and consist of a material of low heat conductivity, preferably of wood, or a plastics material and provided with an upholstered covering which prevents condensation of the steam supplied by the lower pressing plates at the boundary between the trouser legs and the upper pressing plates and the upholstered covering adapts to any unevenness and presses the material uniformly and carries it in a transverse direction.

The upper pressing plates may be additionally heated although this is generally unnecessary.

The upper pressing plates associated with the lower plates are respectively arranged at an angle of about 90°–110° to one another.

The two lower ironing plates are preferably opposite one another at their adjacent ends and form a jaw gripping the upper part of the trousers and move relatively to and from one another. Thus only one lower pressing plate need be movable whilst the other is stationary. The upper part of the trousers is placed in the jaw when opened between the two lower pressing plates. The jaw is then closed and the upper part of the trousers is firmly clamped. In this position the trouser legs lie loosely on the two lower pressing plates. Their ends are then placed in a stretching device which stretches the trouser legs in a longitudinal direction.

Chambers located under the lower pressing plates are then connected to a suction pump and the trouser legs are firmly sucked onto the lower pressing plates. The stretching devices can now be released and removed without the stretched trouser legs springing back. The upper pressing plates are then lowered and the pressing process is carried out by the introduction of steam.

As already described above after the pre-stretching the trouser legs are submitted to a treatment in the region of the seam in the neighbourhood of the hollows under the knee.

The invention will be described with reference to the accompanying drawings.

Figure 1:
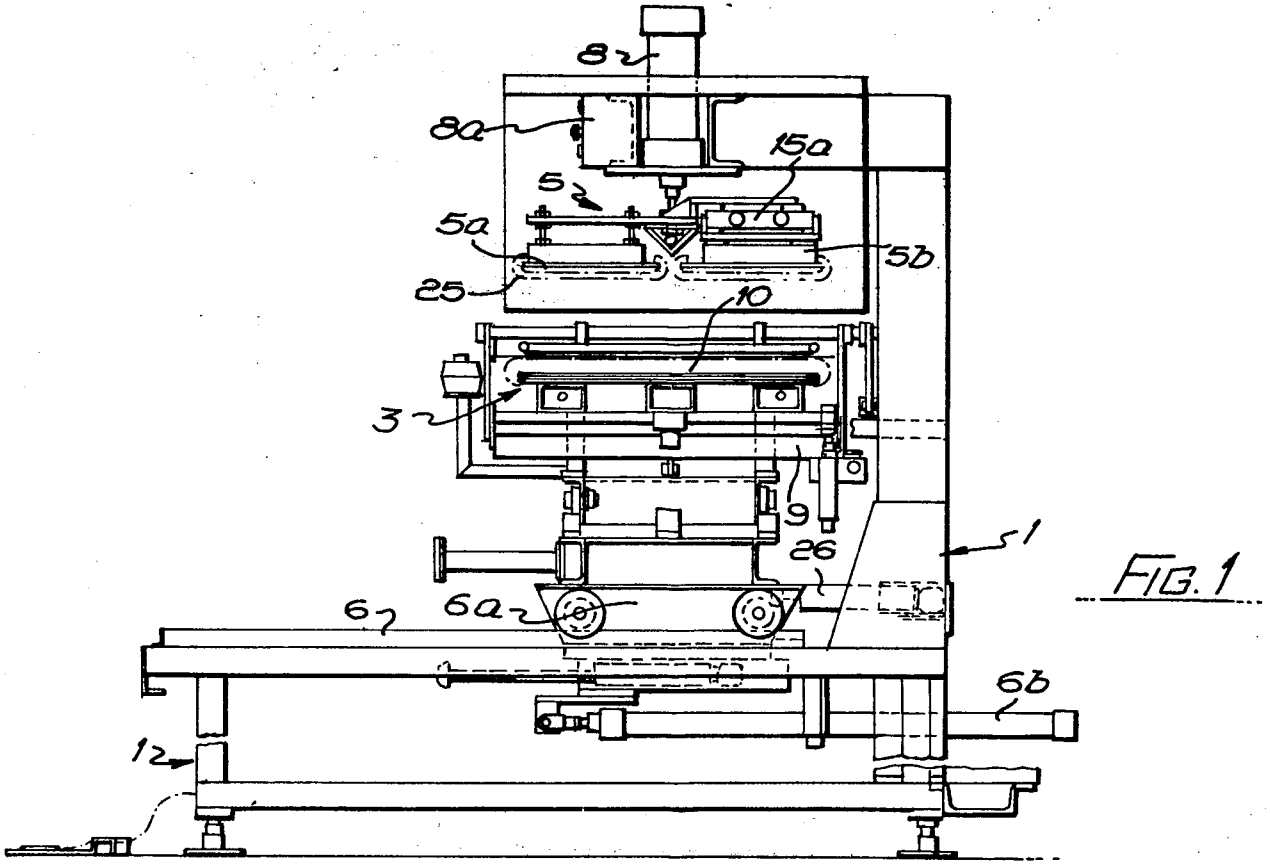
FIG. 1 is a side elevation of the press.

The apparatus shown in the drawings comprises a basic frame 1 and lower and upper pressing plates 2, 3 and 4, 5. The lower pressing plates 2 and 3 and the upper pressing plates 4 and 5 are respectively at angles of 90°–110° preferably 104° to one another. This angular position of the two lower pressing plates 2 and 3 carrying the trouser legs provides a working space between the adjacent longitudinal sides of the pressing plates for an operator and substantially facilitates the handling of the trousers to be pressed. A further facility in handling is achieved in that the two lower pressing plates 2 and 3 are carried by a carriage **6*a* operated by a pneumatic cylinder 6*b* which is mounted for forward and backward movement on guide rails 6 on the frame 1. The carriage 6*a* engages a stop 26 on the frame 1 in the rearward position of the pressing plates 2 and 3 to position the plates vertically below the upper pressing plates 4 and 5. In the pushed back or rearward position the two lower pressing plates 2 and 3 lie below the upper pressing plates 4 and 5 which are connected through adjustable pneumatic cylinders 8 to the basic frame 1 and can be lowered onto the lower pressing plates when in the rearward position. An operating panel 8*a* is mounted on the frame 1**.

A slide **3*a* carries the lower pressing plate 3 on the right hand side in the drawing on guide rails 9 whilst the left lower pressing plate 2 is firmly connected to the frame. The guide rails 9 are at right angles to the guide rails 6 so that the right hand lower pressing plate 3 can be moved transversely from the left hand pressing plate 2 or moved towards this pressing plate. Upon moving the right hand pressing plate away from the left hand plate a gap or space 20 is provided between the plates adjacent to the waistband of a pair of trousers (FIG. 5**) which accommodates the upper part of the trousers and the waistband.

By moving the lower plate 3 towards the stationary plate 2 the pressing plates 2 and 3 firmly hold this waistband part of the trouser.

Figure 2:
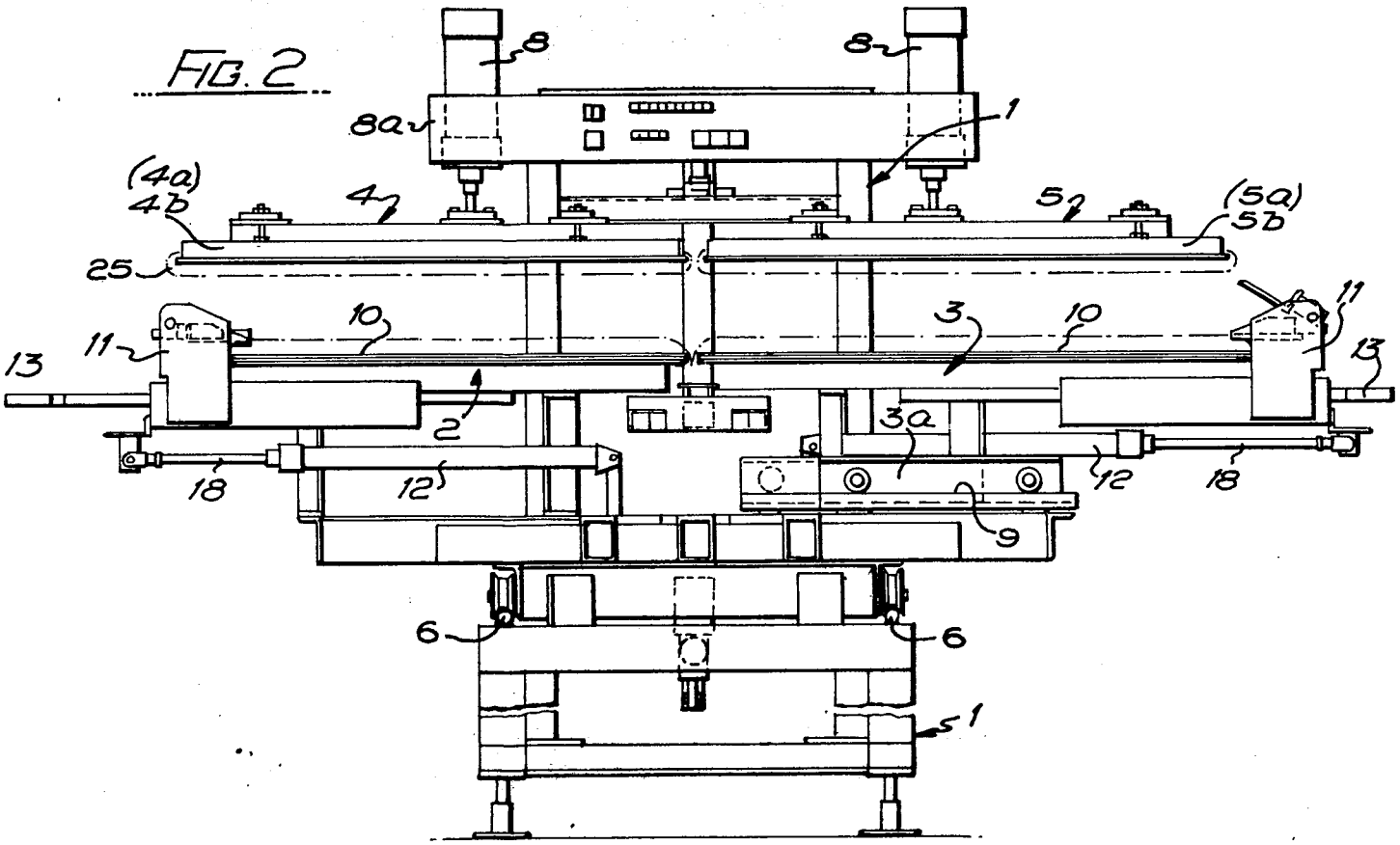
FIG. 2 is a front elevation of same.

Each lower pressing plate 2 and 3 is provided on its outer end with clamps 11 (FIG. 2) capable of being hinged up to receive the free ends of the trouser legs. The opening and closing of each clamp 11 is effected by a cylinder 12 and piston rod 18.

The unit formed by the clamps 11 and the adjusting cylinders 12 is movable in a longitudinal direction on guide rails 13 which extend on both sides of the pressing plates. The movement is effected by the adjusting cylinders 12. The movement stretches the respective trouser legs in a longitudinal direction.

Figure 5:
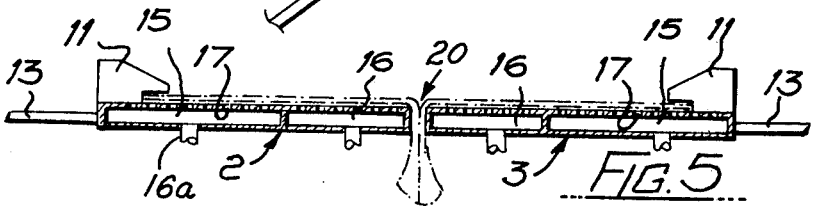
FIG. 5 is a section on line V—V of FIG. 3.

Each lower pressing plate 2 and 3 comprises a flat plate 14 on which is arranged a padding 10 for ironing. The flat plate 14 on each lower pressing plate 2 and 3 is provided over its whole area with holes 17 which allow for the passage of steam and for the applying vacuum to the pad. As shown in FIG. 5 the space under the plate 14 is divided into two chambers 15 and 16.

The chamber 16 is over the end of the pressing plate adjacent to the trouser waistband and extends over the area on which the centre seams reaching from the waistband of the trouser as far as about the region of the hollow below the knee portion. The chamber 15 extends over the remaining area of the lower pressing plate. Both chambers 15, 16 may be connected separately or together to a source of vacuum or connected to a steam supply pipe. Conduits **16*a* for connecting these chambers to a source of steam or vacuum are shown in FIG. 5**.

Figure 3:
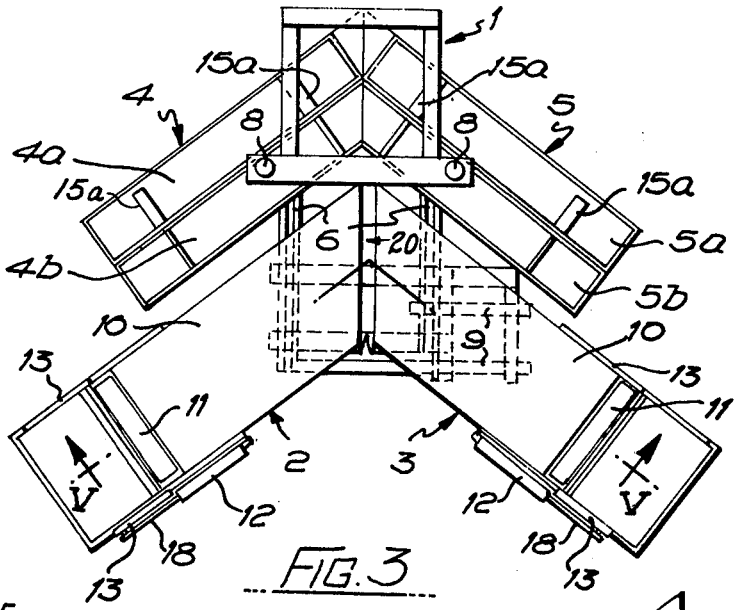
FIG. 3 is a diagrammatic plan of same.
Figure 3A:
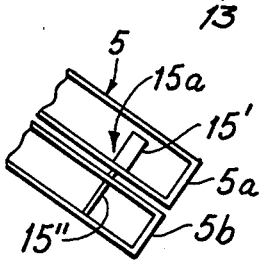
FIG. 3A is a fragmentary detail showing the adjustment for transverse stretch of the trouser legs.
Figure 4:
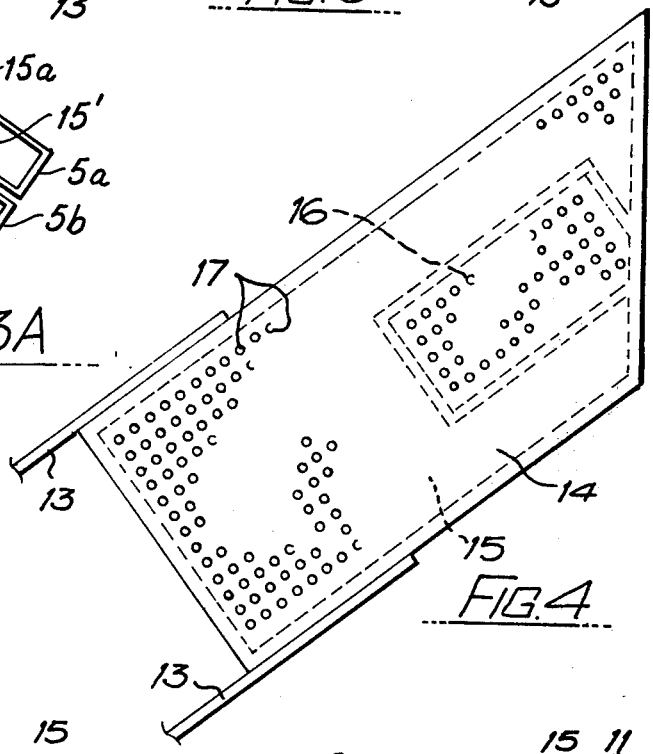
FIG. 4 is a diagrammatic plan view to a larger scale of the left hand lower ironing plate with holes therein.

The two upper ironing plates 4 and 5 which are movable vertically as a unit by means of the adjusting cylinders 8 are connected to the basic frame 1 and each consist of two parts **4*a* and 4*b* or 5*a* and 5*b*. Both pressing plate parts run respectively parallel to the associated lower pressing plate 2 and 3 respectively and are located in the rearward position of the lower pressing plates 2 and 3 vertically thereabove. The two plate parts 4*a* and 4*b* of the upper pressing plate 4 as well as the plate parts 5*a* and 5*b* of the upper pressing plate 5 are connected to one another by means of adjusting members 15*a*. In this way the associated plate parts can be moved apart in pairs transversely of their longitudinal direction. As shown in FIGS. 3 and 3A these adjustment members 15*a* may each comprise a fluid pressure responsive cylinder 15' mounted on one part (4*a*, 5*a*) and connected by piston rod 15" to the other part (4*b*, 5*b*). Upon actuation of the cylinders the parts may be displaced between the FIG. 3 position and the separated FIG. 3A position. Due to the moving apart of the plate parts of the upper pressing plates 4, 5 when lowered onto a trouser leg placed on the lower pressing plates 2 and 3 a transverse stretching of the material of the trouser legs is effected. The two plate parts 4*a* and 4*b* and 5*a* and 5*b* of the upper pressing plates 4 and 5 are provided with a padding 25** extending over the whole width. The padding material must be extensible transversely.

After raising the upper pressing plates and traversing the carriage **6*a* forwardly and moving the lower plate 3 away from the stationary plate 2**, the finished ironed trousers can be removed from the pressing machine.

What is claimed is:

1. A trouser pressing apparatus comprising two lower pressing plates arranged at 90°–110° to each other, a carriage on which the lower pressing plates are mounted, clamps for securing the bottoms of the trouser legs to said plates and applying longitudinal tension thereto, means for applying vacuum to the plates to hold the trouser legs on the plates, means for moving the carriage, a pair of upper plates mounted above the lower pressing plates, said carriage being movable to position the lower plates beneath the upper plates, means for stretching the legs transversely and means for applying pressure and steaming said trousers.

2. An apparatus according to claim 1 in which the upper pressing plates are each formed in two parts and means are provided to separate said parts to stretch the trouser legs transversely.

3. A pressing apparatus according to claim 1, characterised in that the clamps on the two lower pressing plates are movable relatively to one another.

4. A pressing apparatus according to claim 3, characterised in that one lower pressing plate on the carriage is stationary and the other lower pressing plate is movable relatively to the stationary plate.

5. A trouser pressing apparatus comprising a movable carriage, two lower pressing plates mounted on said carriage for receiving the trouser legs, two upper pressing plates disposed above the lower plates, each lower pressing plate being provided with a plurality of holes distributed over its surface communicating with one or more chambers for the introduction of steam or vacuum, a stretching clamp on each lower pressing plate, means for moving the clamps for stretching the trouser leg longitudinally, each upper pressing plate comprising two parts arranged side by side substantially parallel to the lower pressing plates, means for separating said parts to stretch the legs transversely, means for traversing the carriage and lower pressing plate forwardly and rearwardly, and means whereby said upper plates may be lowered toward said lower plates when the carriage has been displaced to position the lower plates beneath the upper plates.

6. A pressing apparatus according to claim 5 in which the upper pressing plates are unheated and consist of a material of low heat conductivity, preferably wood or plastics material, and are provided with padded cover means.

* * * * *

UNITED STATES PATENT OFFICE

CERTIFICATE OF CORRECTION

Patent No. 4,137,655 Dated February 6, 1979

Inventor(s) Wilhelm Engelbart and Dieter Nahr

It is certified that error appears in the above-identified patent and that said Letters Patent are hereby corrected as shown below:

--Foreign Priority Data:

German Patent Application No. 26 46 764
filed October 16, 1976--

Signed and Sealed this

*Thirty-first* Day of *July 1979*

[SEAL]

*Attest:*

*Attesting Officer*

LUTRELLE F. PARKER
*Acting Commissioner of Patents and Trademarks*